US010961681B2

(12) United States Patent
Friesen

(10) Patent No.: US 10,961,681 B2
(45) **Date of Patent: *Mar. 30, 2021**

(54) MANHOLE ASSEMBLY

(71) Applicant: Predl Systems North America Inc., Burnaby (CA)

(72) Inventor: Jed Christopher Friesen, Vancouver (CA)

(73) Assignee: Predl Systems North America Inc., Burnaby (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/793,844

(22) Filed: Feb. 18, 2020

(65) Prior Publication Data

US 2020/0217037 A1 Jul. 9, 2020

Related U.S. Application Data

(63) Continuation of application No. 15/946,643, filed on Apr. 5, 2018, now Pat. No. 10,563,373.

(51) Int. Cl.
*E02D 29/12* (2006.01)
*E02D 29/00* (2006.01)

(52) U.S. Cl.
CPC ..... *E02D 29/124* (2013.01); *E02D 29/125* (2013.01); *E02D 29/127* (2013.01); *E02D 2300/0007* (2013.01)

(58) Field of Classification Search
CPC ... E02D 29/124; E02D 29/125; E02D 29/127; E02D 2300/0007

(Continued)

(56) References Cited

U.S. PATENT DOCUMENTS 541,987 A 7/1895 Whiteside
1,712,510 A 5/1929 Monie (Continued)

FOREIGN PATENT DOCUMENTS

DE 817419 C 10/1951
EP 737617 A1 * 10/1996 ..... E03F 5/024

(Continued)

OTHER PUBLICATIONS

Fernco Inc., "Fernco Saddle", https://www.google.ca/search?q=fernco+saddle&client=safari&hl=en-ca&prmd=sivn%source=Inms&tbm=isch&sa=X&ved=2ahUKEwibgZ2dhPLkAhXWsJ4KHaosDjkQ_AUoAnoECA4QAg&biw=3758,&bih=6358,dpr=3, accessed Sep. 27, 2019, 3 pages.

(Continued)

*Primary Examiner* — Patrick J Maestri
*Assistant Examiner* — Joseph J. Sadlon
(74) *Attorney, Agent, or Firm* — Schacht Law Office, Inc.; Dwayne Rogge

(57) ABSTRACT

A manhole assembly including a base, riser, and cap. The base having an upper surface forming a bench, a bottom surface, and a radially outward surface with penetrations there through; and a radial spigot in the radially outward upper edge of the base. The base having a corrosive-resistant layer covering the channels, bench, and radial spigot. Also disclosed is a riser comprised of a corrosive-resistant polymer pipe having a radially outward surface, an inner surface and a bottom surface in contact with, supported by, and sealed to the radial spigot. The cap having a radial spigot, and access hole; the radial spigot in the radially outward bottom edge of the cap resting upon and sealed to an upper edge of the riser. The radially outward surface of the cap and base are aligned with the radially outward surface of the riser.

15 Claims, 2 Drawing Sheets

(58) Field of Classification Search
USPC ..... 52/20, 19
See application file for complete search history.

(56) References Cited

U.S. PATENT DOCUMENTS

| | | | | |
|---|---|---|---|---|
| 1,955,018 | A | 4/1934 | Rego | |
| 2,025,839 | A | 12/1935 | Woods | |
| 2,030,536 | A | 2/1936 | Rego | |
| 2,239,033 | A * | 4/1941 | Cartmill | B61D 17/16 52/19 |
| 2,254,668 | A | 9/1941 | Tomek | |
| 2,620,749 | A * | 12/1952 | West | B61D 17/16 105/377.07 |
| 2,681,494 | A | 6/1954 | Weber | |
| 3,090,160 | A * | 5/1963 | Shaver | B61D 17/16 52/19 |
| 3,331,295 | A * | 7/1967 | Sorrell | B66F 19/005 404/26 |
| 3,370,386 | A | 2/1968 | Martin | |
| 3,462,896 | A | 8/1969 | Lokensgaard | |
| 3,477,106 | A | 11/1969 | Tetzlaff et al. | |
| 3,533,199 | A | 10/1970 | Pickett | |
| 3,715,958 | A | 2/1973 | Crawford et al. | |
| 3,787,078 | A | 1/1974 | Williams | |
| 3,965,233 | A | 6/1976 | Ritter | |
| 4,102,088 | A | 7/1978 | Keller et al. | |
| 4,119,291 | A | 10/1978 | Polito | |
| 4,123,033 | A * | 10/1978 | Joelson | B28B 7/0011 249/100 |
| 4,127,990 | A | 12/1978 | Morrow | |
| 4,275,757 | A | 6/1981 | Singer | |
| 4,318,880 | A | 3/1982 | McIntosh et al. | |
| 4,346,921 | A | 8/1982 | Gill et al. | |
| 4,372,017 | A | 2/1983 | Heckethorn | |
| 4,419,231 | A | 12/1983 | Friedl | |
| 4,422,994 | A | 12/1983 | Ditcher | |
| 4,591,290 | A | 5/1986 | Prescott | |
| 4,621,941 | A | 11/1986 | Ditcher et al. | |
| 4,682,907 | A | 7/1987 | Gaudin | |
| 4,776,138 | A | 10/1988 | Sumner et al. | |
| 4,776,722 | A * | 10/1988 | Gaudin | E02D 29/14 210/164 |
| 4,927,290 | A | 5/1990 | Bowman | |
| 5,017,313 | A | 5/1991 | Trimble | |
| 5,081,802 | A | 1/1992 | Westhoff et al. | |
| 5,100,697 | A | 3/1992 | Nielsen | |
| 5,261,766 | A | 11/1993 | Anderson | |
| 5,263,298 | A | 11/1993 | Ballesteros | |
| 5,303,518 | A | 4/1994 | Strickland | |
| 5,308,192 | A | 5/1994 | Srackangast | |
| 5,360,131 | A * | 11/1994 | Phillipps | E02D 29/1409 220/3.7 |
| 5,386,669 | A | 2/1995 | Almeida | |
| 5,413,307 | A | 5/1995 | Tidwell | |
| 5,451,081 | A | 9/1995 | Kaucnik | |
| 5,536,420 | A | 7/1996 | Oyzboyd | |
| 5,549,411 | A | 8/1996 | Hawkins | |
| 5,564,860 | A | 10/1996 | Amann | |
| 5,885,446 | A * | 3/1999 | McGrew, Jr. | B01F 1/0027 210/198.1 |
| 5,979,117 | A | 11/1999 | Fuller | |
| 6,202,370 | B1 * | 3/2001 | Miller | B28B 7/0008 52/169.14 |
| 6,385,913 | B1 | 5/2002 | Ahn | |
| 6,393,771 | B1 | 5/2002 | Stetson | |
| 6,428,701 | B1 * | 8/2002 | Mullennix | C02F 1/687 210/153 |
| 6,457,901 | B1 | 10/2002 | Sondrup | |
| 6,746,178 | B1 | 6/2004 | Hensley et al. | |
| 6,851,225 | B1 | 2/2005 | Haar et al. | |
| 7,144,189 | B1 * | 12/2006 | Bongiovanni | B65D 90/105 404/25 |
| 7,347,644 | B2 * | 3/2008 | Meyers | E02D 29/12 404/25 |
| 7,473,373 | B1 | 1/2009 | Danler | |
| 7,695,213 | B1 | 4/2010 | Akkala et al. | |
| 7,748,926 | B2 | 7/2010 | Jurich et al. | |
| 8,851,789 | B2 | 10/2014 | Bax | |
| 9,011,035 | B2 * | 4/2015 | Munro | E02D 29/121 404/26 |
| 9,175,705 | B1 | 11/2015 | Clark, Jr. et al. | |
| 9,890,513 | B1 | 2/2018 | Wu et al. | |
| 10,138,615 | B2 | 11/2018 | Kim et al. | |
| 10,214,893 | B2 | 2/2019 | Skinner et al. | |
| 10,294,627 | B2 | 5/2019 | Bechler et al. | |
| 10,344,447 | B2 | 7/2019 | Sauve et al. | |
| 10,370,181 | B1 * | 8/2019 | Plummer | C02F 1/688 |
| 10,428,548 | B2 * | 10/2019 | Yano | E04H 9/028 |
| 10,442,617 | B1 * | 10/2019 | Holbrook | B65D 90/023 |
| 10,458,093 | B2 | 10/2019 | Gilbert | |
| 10,563,373 | B1 | 2/2020 | Friesen | |
| 10,662,606 | B1 | 5/2020 | Friesen | |
| 10,689,834 | B2 * | 6/2020 | Levesque | E02D 29/12 |
| 2004/0081517 | A1 * | 4/2004 | Hartman | E01F 9/619 405/284 |
| 2005/0000175 | A1 * | 1/2005 | Machledt | H02G 9/10 52/220.1 |
| 2005/0100412 | A1 | 5/2005 | Houck | |
| 2006/0065994 | A1 | 3/2006 | Zotto | |
| 2007/0053747 | A1 | 3/2007 | O'Brien | |
| 2011/0013991 | A1 | 1/2011 | Watson et al. | |
| 2012/0141210 | A1 | 6/2012 | Kiest, Jr. | |
| 2013/0336723 | A1 | 12/2013 | McKinney et al. | |
| 2016/0097180 | A1 | 4/2016 | Pesonen | |
| 2016/0145848 | A1 | 5/2016 | Skinner et al. | |
| 2018/0305888 | A1 | 10/2018 | Bonell et al. | |

FOREIGN PATENT DOCUMENTS

| | | | | |
|---|---|---|---|---|
| EP | 2604758 | B1 * | 4/2014 | E02D 29/124 |
| GB | 2145444 | A * | 3/1985 | E03F 5/024 |
| JP | 2006090047 | A * | 4/2006 | E02D 29/124 |
| JP | 2014077249 | A * | 5/2014 | |
| JP | 2016145484 | A * | 8/2016 | |

OTHER PUBLICATIONS

Hobas, "Hobas Tee Manhole", https://www.google.ca/search?q=hobas+tee+manhole&client=safari&hl=en-ca&prmd=isnv%source=Inms&tbm=isch&sa=X&ved=2ahUKEwiR19vEhPLkAhUNvp4KHTVFBpYQ_AUoAXoECAsQAQ&biw=375&bih=635, accessed Sep. 27, 2019, 9 pages.

National Liner, "The 3S Segment Panel System: for the structural rehabilitation and restoration of storm sewers, sanitary sewers, sanitary sewers and culverts", https://www.nationalliner.com/portals/0/pdf/3-pannel-system.pdf, accessed Nov. 5, 2019, 4 pages.

National Precast Concrete Association, "Watertight Manhole Joints," Jun. 2013, 4 pages.

* cited by examiner

MANHOLE ASSEMBLY

RELATED APPLICATIONS

This application claims priority benefit of and is a Continuation of U.S. Ser. No. 15/946,643 filed Apr. 5, 2018.

BACKGROUND OF THE DISCLOSURE

Field of the Disclosure

This disclosure relates to the field of manholes assemblies for access to an underground sewer system with corrosion resistant components.

BRIEF SUMMARY OF THE DISCLOSURE

Disclosed herein is a manhole assembly. The manhole assembly in one example comprising: a manhole base, riser, manhole cap, and cover assembly. The manhole base in one example comprising an aggregate main body having an upper surface forming a bench, a bottom surface, and a radially outward surface with penetrations there through; channels formed in the upper surface of the manhole base fluidly connecting the penetrations; and a radial spigot in the radially outward upper edge of the manhole base. The manhole base having a continuous corrosive-resistant layer covering the channels, bench, and radial spigot. Also disclosed in one example is a manhole riser comprised of a corrosive-resistant structural polymer pipe having a radially outward surface, an inner surface and a bottom surface in contact with, supported by, and sealed to the radial spigot. The manhole cap in one example comprising an aggregate main body having an upper surface, a bottom surface, and a radially outward surface; a radial spigot in the radially outward bottom edge of the manhole cap; the manhole cap having a continuous corrosive-resistant covering the bottom surface, radial spigot, and access hole; the radial spigot in the radially outward bottom edge of the manhole cap resting upon and sealed to an upper edge of the manhole riser; wherein the radially outward surface of the manhole cap is aligned with the radially outward surface of the manhole riser, and the radially outward surface of the manhole base is aligned with the radially outward surface of the manhole riser.

The manhole assembly may be arranged wherein the manhole riser comprises polyvinyl chloride.

The manhole assembly may be arranged wherein the riser consists of polyvinyl chloride.

The manhole assembly may be arranged wherein the aggregate material is concrete.

The manhole assembly may be arranged wherein the manhole base has an outer diameter equivalent and substantially aligned with the outer diameter of the riser.

The manhole assembly may further comprise a wrap seal sealed to the radially outer surface of the riser and the manhole base.

The manhole assembly may be arranged wherein the manhole cap has an outer diameter equivalent and substantially aligned with the outer diameter of the riser.

The manhole assembly may further comprise a wrap seal sealed to the radially outer surface of the riser and the manhole cap.

The manhole assembly may be arranged wherein the riser is a length of straight pipe.

The manhole assembly may be arranged wherein the pipe is a monolithic structure of corrosion resistant material.

DETAILED DESCRIPTION OF THE DISCLOSURE

Figure 1:
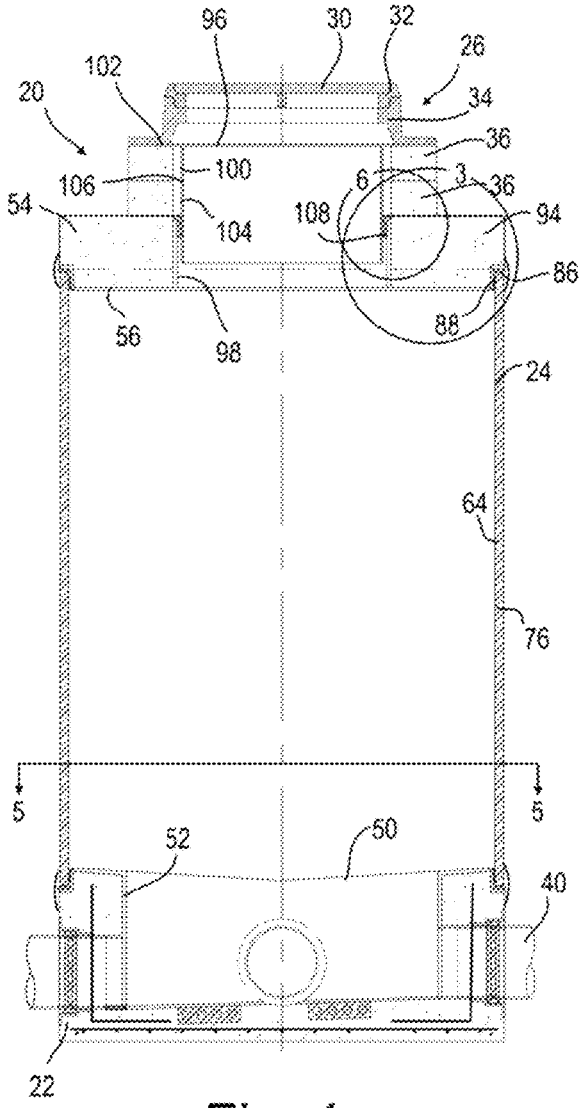
FIG. 1 is a front cutaway view of one example of the disclosed manhole assembly. This view taken along line 1-1 of FIG. 5.

Manhole casings such as disclosed in U.S. Pat. No. 1,712,510 generally comprise a bottom section (1) with a plurality of risers (7) and (8) attached thereto with a manhole cover (18) or lid attached thereto. These manholes allow for access via removal of the manhole cover (18) to a system of fluid conduits (5, 6) which are connected via the open region of the bottom section (1). The bottom sections of such manholes as shown in this example are flat and allow for undirected, horizontal flow of fluid from an inlet pipe or multiple inlet pipes to an outlet pipe.

In other applications, it may be desired to form fluid channels from the inlet pipes to the outlet pipe. Often, the radial angle, elevation angle, and elevation of each of the inlet pipes and outlet pipe connections to a base may be aligned prior to installation of the overall fluid system so as to allow utilization of pre-set, precast manhole bases. Many such pre-cast manhole bases can be manufactured in standard configurations such as straight through, T, cross, and other standard configurations. Such standard configurations are especially useful where the elevation angle and elevation of the inlet pipes to the outlet pipes can be preset prior to installation of the inlet pipe(s) and outlet pipe.

In some applications, such standard configuration pre-cast manhole bases are not financially viable due to the constraints placed by non-standard radial angle(s), elevation angle(s), and elevation(s) of the inlet pipes and outlet pipes. One unknown solution is to form a manhole casing with a (cylindrical) manhole having a flat (planar) floor. A volume of grout, concrete, or other aggregate material is then disposed into the manhole base and manually formed into fluid channels. The term "concrete" is used herein to define a heavy, rough building material made from a mixture of broken stone or gravel, sand, cement, and water, that can be spread or poured into molds and that forms a stone-like mass on hardening. Holes are then drilled through the cylindrical manhole base radially inward upon which couplers may be grouted or otherwise attached to the holes drilled through the manhole base at multiple angles to conform to the requirements of the installation.

A sanitary sewer is a system of underground pipes that carries sewage from bathrooms, sinks, kitchens, and other plumbing components to a wastewater treatment plant where it is filtered, treated and discharged. A storm sewer is a system designed to carry rainfall runoff and other drainage to a location where it may be treated, such as by allowing sediments to settle out before the water is discharged.

One additional detriment of sanitary sewers over storm sewers is that sanitary sewer systems are prone to corrosion chemicals which may corrode the linings and structures of many materials commonly found in the construction of manholes, such as concrete, etc.

Manhole assemblies have been found to typically experience significant interior corrosion and deterioration. Nevertheless, hydrogen sulfide, which is common in sewage, is developed due to the presence of sulfur compounds, such as sulfate, sulfite, or other inorganic or organic sulfur. These compounds are reduced to sulfide by sulfate-reducing bacteria normally found in the effluent. The generation of hydrogen sulfide is accelerated in the presence of high temperature and low flow rates.

Coatings have been applied to the inner surfaces of manhole assemblies, but have not been reliable, and are time consuming and expensive.

Linings of plastic material, such as polyvinyl chloride (PVC), applied to the inner surface of a concrete structure are known to provide corrosion resistance for interior corrosion protection against hydrogen sulfide. Such plastic linings are further compatible with plastic pipe now being used extensively in sanitary systems. To date, however, it is extremely difficult to fabricate interior linings and integrate such interior linings into vertical structures and particularly manhole assemblies. Flexible type linings are presently used in pipes covering the upper 270° of the pipe interior. This portion is attacked by the $H_2S$ generated from sewage. This flexible material is not easily used on manholes which require 360° protection for the manhole interior.

U.S. Pat. No. 4,751,799, issued Jun. 21, 1988, and U.S. Pat. No. 5,081,802, issued Jan. 21, 1992, disclose liners formed of a rigid or semi-rigid material. These liners are fabricated in sections and applied postproduction as a corrosive seal to the structural component which is most commonly an aggregate (concrete). The aggregate/concrete portions of this disclosed apparatus in one example conforming to ASTM C478. Generally, each liner section comprises a curved molded member which may, for example, be thermo-formed. Each molded member is provided with a means for securing the liner into the aggregate (concrete) structure. The liner sections are joined together via a bell at the upper end, and a spigot at the bottom end, these connections are generally caulked or otherwise sealed along their engaging edges. The projections of ducktail cross-section extend outwardly from the convex surfaces of the mold members which are arranged with an interior mold assembly and are either joined against the surface of an interior mold member by standard plastic banding or are alternatively joined together end-to-end by individual holding members. These assemblies have been found to lack suitable structural strength and present additional problems in their handling and assembly. In addition, the caulking material has been found to provide unsatisfactory waterproof seams within the manhole assembly structure.

One detriment of pre-cast/grouted/drilled construction methods is that due to the nature of construction, fluid may enter between the pre-cast concrete sections, causing an unsanitary situation when infiltration is not treated and potentially causing damage should the fluid expand in this gap such as by freezing thus cracking the casing, cap, and/or the cylindrical base. Disclosed herein, beginning with FIG. 1, is shown a manhole assembly 20 including manhole base 22, riser 24, and a manhole cap 54 particularly formed using a method which allows for one-off or individual casting of the manhole base 22 and other components with improvements over prior construction methods. One such method is disclosed in U.S. patent application Ser. No. 15/367,121 (The '121 Application) filed on Dec. 1, 2016 incorporated herein by reference.

The manhole assembly 20 and several methods of manufacture will be described in much more detail below, with reference to a base manufactured in one example according to the disclosure of the '121 Application.

The manhole assembly 20 in this disclosure includes the base 22, a riser 24 and a manhole cap 54 including the cover assembly 26. The cover assembly 26 is normally at ground level 28 so as to be easily accessed by personnel needing access to the fluid channels therein and fluid conduits extending therefrom. Commonly, the cover assembly 26, including the removable cover 30, is disposed in a roadway or sidewalk for easy access. Thus, it is normally desired to maintain a planar upper surface with the surrounding ground level, the cover 30 generally fits within a recess 32 of an upper ring assembly 34 and has an upper surface coplanar or substantially coplanar with the ground lever adjacent thereto. In one installation, the upper ring assembly 34 is attached to or formed with one or more cap risers 36 so as to correctly position the upper surface of the cover 30 at ground level.

In use, the manhole assembly 20 is assembled within an excavation 38. Once the manhole base 22 is installed, inlet pipe(s) 40 and/or an outlet pipe 42 may be attached to the manhole base 22. The excavation 38 outside of the manhole assembly 20 is then back-filled up to the ground level 28, substantially burying the manhole assembly 20 except normally for the cover 30. Access to the interior of the manhole assembly 20 and components thereof may then be achieved by way of the cover 30.

Figure 5:
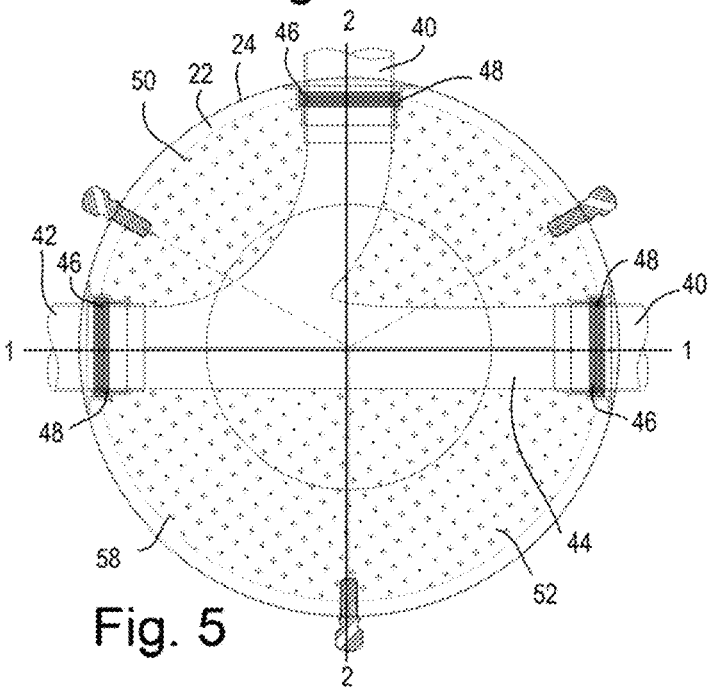
FIG. 5 is a plan view taken along line 5-5 of FIG. 1.
Figure 6:
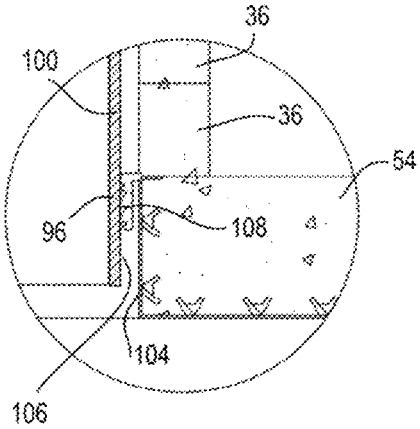
FIG. 6 is a detail view of the region 6 of FIG. 1.

Also shown in FIG. 5 is a plurality of fluid channels 44. These fluid channels 44 are commonly open-topped fluid conduits which connect inlet pipes 40 to the outlet pipe 42 and allow access thereto.

In most examples, each of the fluid channels 44 connects to an inlet pipe 40 to an outlet pipe 42. Generally, each inlet pipe 40 and outlet pipe 42 is aligned with a penetration 46 through the manhole base 22 which is connected to a pipe or conduit external of the manhole assembly. Lateral connections may also be made through the manhole cap 54, or through the riser 24. As shown, one or more of the penetrations 46 may have a coupling such as a bell connector 48 and/or flexible entry boot or funnel attached thereto allowing for easy installation of an inlet pipe 40 or outlet pipe 42 to the exterior of the manhole assembly 20. Generally, the bell connector 48 or funnel includes a compression seal gasket ensuring a fluid tight seal between the pipe and the channel penetration 46.

As can be seen in the examples, a bench 50 is provided on an upper surface of the manhole base 22. The bench 50 being substantially horizontal, in one example with a slight radial angle downwards toward the center to allow fluids thereon to flow into the fluid channel 44. The bench 50 may be provided to distinguish individual channel(s) 44, and to provide a surface upon which users can stand so as to be clear of the fluid passing though the fluid channels 44. In this example, the bench 50 is separated into separate regions which may include a non-skid surface thereupon where a person may stand. Commonly, a user entering the manhole assembly 20 will stand upon the bench 50 during inspection and/or maintenance or cleaning of the interior surfaces and components of the manhole assembly 20. Thus, a nonskid surface may be desired to reduce slippage. This non-skid surface may be formed during production of a liner as disclosed in the '121 application or may be formed directly on the casting material in examples where no liner is used.

Disclosed in the '121 Application, the example manhole base 22, risers 36, and cap shown comprises a cast, aggregate wastewater manhole with a material comprising chemically resistant polypropylene (PP), polymerized vinyl chloride (PVC), fiberglass reinforced plastics (FRP) thermoplastic, or other corrosive-resistant material. This corrosive-resistant material forming a corrosive protective liner (CPL) 52 on the base 22, or a CPL 56 on the inner surface of the cap 54. In non-corrosive applications, the manhole base 22 may not utilize a non-corrosive liner, such as for example stormwater application. In one example, the coating thickness is in a range from 0.12"-0.20" (3-5 mm), mechanically bonded with the concrete base, cap, or cap riser structure during the precast concrete process disclosed in the '121 Application. The term precast indicating that the disclosed manhole base 22 and/or other separate components are cast (formed, manufactured, produced) prior to installation at an excavation.

By casting the entire interior structure and surface of the manhole base 22 in one piece with a corrosive-resistant liner 52, and separately casting the manhole cap 54 with a similar liner 56, with substantially no post installation grouting of channels and/or couplers in that these components and the sealed liner are produced in the casting process, the disclosed manhole assembly 20 demonstrates design criteria essential for long term protection and efficient stormwater, wastewater, sewage, and other fluid transmission.

The disclosed apparatus forms a unique solution for corrosion, abrasion, exfiltration, inflow, and/or infiltration.

Several examples of the disclosed apparatus formed using the disclosed construction method also provide ease of installation. The joints between the manhole base 22, riser 24, manhole cap 54, cap risers 36, and cover assembly 26 may be assembled with a fluid impervious seal using a capped heated extrusion weld, butyl caulking, flexible joint seal, or other methods known in the art. Once the manhole assembly 20 with a manhole base 22, riser 24, cap 54, and cover assembly 26 is installed it is ready to be put into service, often without any sealant cure time required. The disclosed manhole assembly 20 provides water-tight connections which resist settling, expansion and contraction stresses after the manhole has been installed.

Adherence to municipal design standards and allowances for inflow and infiltration (I&I) in sanitary and wastewater sewage systems can be accomplished with the disclosed manhole assembly 20 and production method.

The optional non-skid surfaces on the bench portions 50 of the disclosed manhole base 22 may be made of, or covered with, a corrosive-resistant, textured layer; they are safe and secure for maintenance staff in a confined, difficult working environment.

As previously disclosed, a high strength mechanical bond may be achieved by using aggregate and steel lattice or similar anchoring systems. Pipe penetrations 46 and optional connectors such as, for example, bell connectors 48 may be molded for specific installation configurations during manufacturing/casting of the manhole base 22. This molding of the penetration and/or bell connector often negates the need to field core (drill) and attach ancillary connections after casting. Installation time and costs are substantially reduced by molding the connections into the manhole base 22.

In one example production method as disclosed in the '121 application, concrete or other casting material is poured around a pre-formed corrosive-resistant liner and male mold assembly while the liner and male form of the manhole base 22 is in an inverted position; the cap 54 and cap risers 36 may be made by the same process, in an upright orientation when cast. In one example the casting exceeds a minimum 4000 P.S.I. casting. In one example, a high-strength mechanical bond between the corrosive-resistant liner and concrete is achieved by way of a well-proven interface consisting of specifically sized clean aggregate and steel coil/lattice bonded to the bottom of the liner. With vibrated concrete attaching itself to this continuous multi-faceted bonding medium, intruding forces of groundwater backpressure is not of concern.

The disclosed manhole base 22 with an optional liner is a component of a manhole base assembly 20 for new manhole construction or for manhole rehabilitation. Microbial induced corrosion (MIC) has been increasingly evident in concrete manhole casings and related sanitary sewer structures for decades. MIC occurs when sulfuric acid, generated from raw sewage, reacts with the properties of cement to diminish the integrity of concrete manhole bases and related structures.

Hydrogen sulfide ($H_2S$), in anaerobic and aerobic forms, has the capacity to severely damage concrete components. Prior to 1980, heavy metals in wastewater retarded the growth of bacteria in sewer systems, minimizing MIC. Since the US Clean Water Act (1980) mandated the elimination of certain toxic heavy metals—lead, chromium, mercury, arsenic, cadmium—from wastewater, effluent MIC has reached acute levels in sanitary and wastewater sewage systems; these heavy metals are toxic to humans and other life forms, including bacteria. Now, bacterial colonies flourish and assist with the generation of $H_2S$ gas and, with oxidation, $H_2SO_4$. Acidic deterioration of sanitary sewer pipelines and manholes has increased substantially. Coating systems that once protected concrete structures are known to fail. Splash and turbulent water flow exacerbate the destructive effect on concrete manholes. More aggressive corrosion can be expected when septic conditions exist, which may also result in leaking pipe connections. Other contributing factors, such as drop connections or a large number of entry points introduced into the structure, create more acid corrosion problems.

The disclosed method and manhole assembly 20 improves resistance to MIC by removing any gaps between the channel body and the outer wall. The optional gapless liner covering the channel body of the base, utilizing a riser 24 with no concrete or similar composition also improves resistance to MIC.

These new conditions require revised design parameters for many components in the sewage transmission system, including manholes. Liner material, such as fiberglass reinforced plastic (FRP) and polypropylene (PP), can be applied to newly poured concrete to provide a dense, impervious and continuous corrosive-resistant lining for the manhole base 22, cap 54, and/or cap risers 36 to protect the concrete substrate from destructive acid corrosion. This deteriorated concrete condition can be prevented in one example with thermoplastic barriers that isolate the sewage from the concrete components of the manhole assembly 20 or using non-concrete materials.

As evidenced by the anaerobic process, the eventual disintegration of the concrete components of a manhole assembly 20 is often the result of a hydrogen sulfide attack. More aggressive corrosion can be expected when septic conditions exist, which may also result in leaking pipe connections. Other contributing factors, such as drop connections or a large number of entry points introduced into the structure, create more acid corrosion problems.

The disclosed manhole base 20 and construction method ensures complete coverage of the channel body, and gapless attachment of the liner to the concrete casting.

Figure 2:
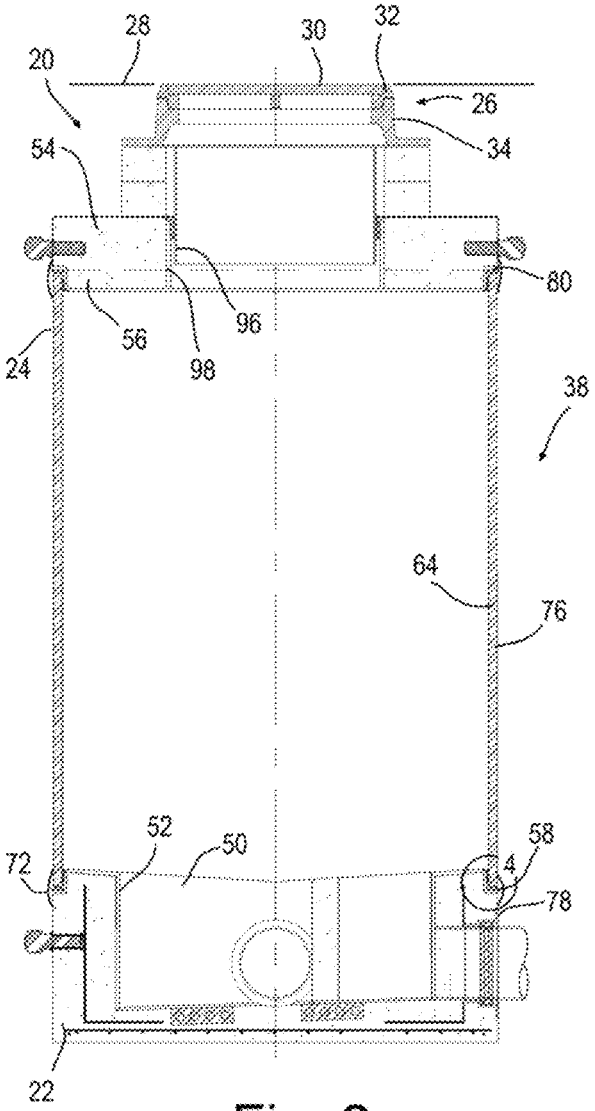
FIG. 2 is a side cutaway view of the example shown in FIG. 1 taken along line 2-2 of FIG. 5.
Figure 4A:
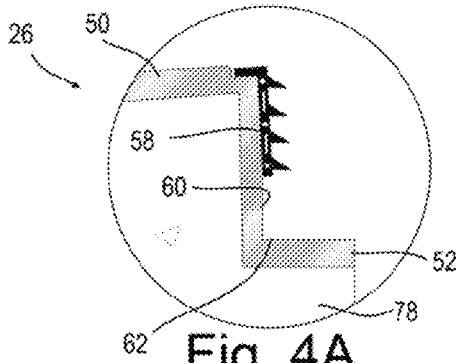
FIG. 4A is an enlarged detail view of the region 4 of FIG. 2 showing an example not attached to a riser.
Figure 4B:
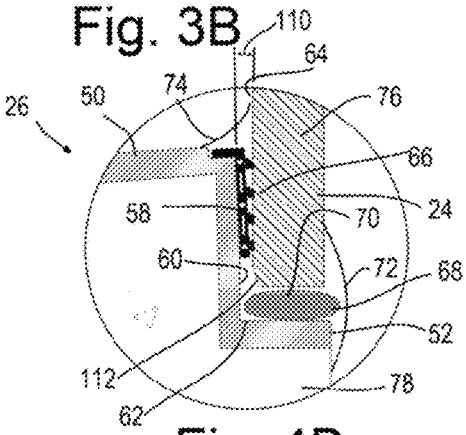
FIG. 4B is an enlarged detail view of the region 4 of FIG. 2.

Looking to FIGS. 1, 2, and 4 are shown cross-sectional views of a manhole assembly 20 using the disclosed apparatus. In this example, the manhole base 22 has a radial recess or spigot 58 in the upper, radially outward edge thereof. This spigot 58 having a substantially vertical surface 60 and a cooperating horizontal surface 62 to form the spigot 58 for receiving the riser 24. In one example, the vertical surface 60 is tapered inward to allow for easier connection to the riser 24. In one example the taper is between 1° and 5°. The riser 24 resting solely on the bottom surface 62 of the spigot 58 and not engaging the upper surface 50. In one example an ASTM C443-compliant gasket 66 is applied between the radially inner surface 64 of the riser 24 and the vertical surface 60 of the spigot 58. In one example a Hamilton Kent Tylox™ Type "C" gasket model #5796 is used as the gasket 66. In another example, an ASTM C990 "Mastic" joint may be utilized instead of or in combination with a gasket 66.

In addition, a seal 68 may be used between the longitudinally bottom edge 70 of the riser 24 and the bottom surface 62 of the spigot 58. This seal 68 may be a fluid component such as grout, fluid silicone, mastic, etc., or a manufactured seal such as rubber tape, rolling tube seal, etc.

The disclosed connection between the riser 24 and the manhole base 22 in one example provides for a smooth surface transition between the outer surface of the base 22 and the outer surface of the riser 24 which allows for the use of an ASTM C877-compliant external joint wrap 72 which seals to the each of the outer surface of the base 22 and the riser 24, hindering fluid passage therebetween. The joint wrap 72 may be tape, polymer films, silicone, hardening fluids, resin impregnated fabrics, and combinations thereof. Looking to FIG. 2 for example, it can be seen that the radially outward surface 76 of the riser 24 is substantially aligned with the radially outward surface 78 of the manhole base 24. Prior known installations using a bell on the base required a larger outer diameter on the base than the riser, commonly precluding application of an external joint wrap 72.

Similarly, an internal seal 74 may be added between adjacent components, such as grout, silicone, polymers, or other materials added after connection of the riser 24 to the inner surfaces of the riser 24 and the inner surface of the manhole base 22.

Figure 3A:
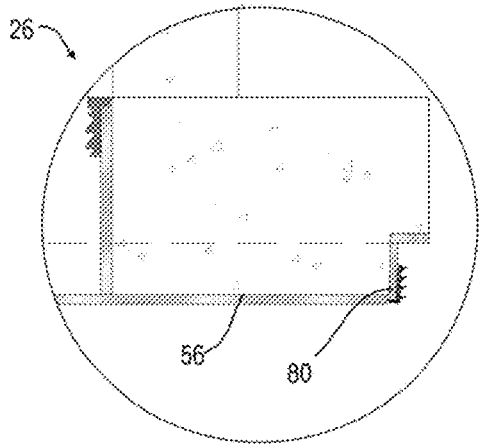
FIG. 3A is an enlarged detail view of the region 3 of FIG. 1 showing one example of a manhole cap component not attached to a riser.
Figure 3B:
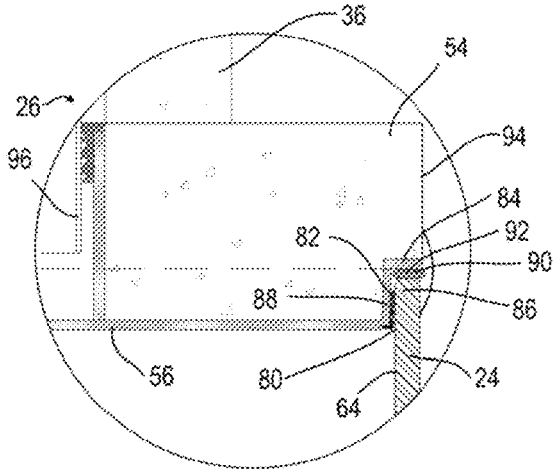
FIG. 3B is an enlarged detail view of the region 3 of FIG. 1.

FIGS. 1, 2, and 3 show a similar attachment of the manhole cap 54 to the riser 24 where the manhole cap 54 comprises a radially outer and vertically lower edge forming a spigot 80 having a radially inner surface 82 facing the inner surface 64 of the riser 24 and an upper surface 84 resting on the longitudinal end 86 of the riser 24. Thus, in one example the entire weight of the cap 54 rests on the end surface of the riser 24 and no bell is required.

In one example an ASTM C443-compliant gasket 88 is applied between the radially inner surface 64 of the riser 24 and the vertical surface 82 of the spigot 80. In one example a Hamilton Kent Tylox™ Type "C" gasket model #5796 is used as the gasket 88. In another example, an ASTM C990 "Mastic" joint may be utilized instead of or in combination with a gasket 88.

In applications where the fluid level in the fluid channels 44 is unlikely to rise to the level of the spigot 82, the gasket 88 may be omitted.

As with the connection between the manhole base 22 and the riser 24, the connection between the manhole cap 54 and the riser 24 may be sealed with a seal 90 positioned used between the longitudinally upper edge 86 of the riser 24 and the surface 84 of the spigot 80. This seal 90 may be a fluid component such as grout, fluid silicone, mastic, etc., or a manufactured seal such as rubber tape, rolling tube seal, etc.

The disclosed connection between the riser 24 and the manhole cap 54 in one example provides for a smooth outer surface transition between the manhole cap 54 and the riser 24 which allows for the use of an ASTM C877-compliant external joint wrap 92 sealing to each of the manhole cap 54 and the riser 24, hindering fluid passage. The joint wrap 92 may be tape, polymer films, silicone, hardening fluids, resin impregnated fabrics, and combinations thereof. Looking to FIG. 2 for example, it can be seen that the radially outward surface 76 of the riser 24 is aligned with the radially outward surface 94 of the manhole cap 54. Prior known installations using a bell on the manhole cap required a larger outer diameter on the manhole cap than the riser, commonly precluding application of an external joint wrap 92.

In one example, the riser 24 is a length of straight pipe formed of a corrosive-resistant material. Such pipes are easily constructed using known methods in lengths using additional connectors when needed, or a bell/spigot pipe having a bell connector on one end and a spigot on the opposing end. By utilizing a straight pipe, with spigots on each of the base and cap, the bell may be omitted from the pipe. The riser 24 may comprise chemically resistant polypropylene (PP), polymerized vinyl chloride (PVC), fiberglass reinforced plastics (FRP) thermoplastic, or other corrosive-resistant material. In one example the riser is monolithic, consisting of one unbroken, unsegmented material. By so forming the manhole assembly 20 with a monolithic riser 24, the outer diameter, weight, and other benefits are accomplished.

In addition, root intrusion is reduced in that joints between riser sections are eliminated. In one example, the main joints are first between the manhole cap 54 and the riser 24, and second between the riser 24 and the manhole base 22.

One significant advantage of this over other known installations, such as that utilized by the Ipex™ company, is the use of the spigot 58 on the base. Optionally, a similar spigot 80 is provided on the manhole cap 54. Whereas the prior art has utilized a bell on the base or a bell on the cap, thus sealing the base and the cap to the outer radial surface of the riser sections. The Ipex™ application thus requiring a larger excavation, larger/heavier/more difficult to install or transport manhole base and cap.

In one example, the gaskets 66 and 82 are secured to the manhole base 22 and manhole cap 54 respectively prior to connection of the base 22 and manhole cap 54 to the riser 24.

For adequate sealing, testing has shown that the wraps 72/92 are sufficient for sealing the components, and the gaskets 66, 82, 68, and 90 are not required for sealing of the manhole assembly 20. In some jurisdictions, such gaskets are legally required.

FIGS. 1, 2, 3, and 6 also show additional components of the manhole assembly 20. These including a sliding hat 96. The sliding hat 96 positionally engaging a surface defining an access hole 98 of the manhole cap 54. The access hole 98 in one example extending through the manhole cap 54, hat 96, risers 36, and cover assembly 26. The cover 30 closing the access hole 98 from undesired entry.

In the example shown, the hat 96 comprises a cylinder 100 and a radially protruding rim 102. The rim 102 resting on the manhole cap 54, or on a riser 36 when risers are used. The cover assembly 26 in one example resting above the rim 102 and in some applications attached thereto.

The cylinder 100 having a radially inward surface providing part of the access hole 98, and a radially outward surface 106 adjacent to or in contact with a radially inward surface 104 of the manhole cap 54. This arrangement allowing for vertical positioning of the hat 96 relative to the manhole cap 54 and allowing for risers 36 and vertical adjustment thereof such as by application of spacers, grout, etc. to raise the cover assembly 26 to the ground level 28 as previously discussed.

In one example, a gasket 108 is attached to the inner surface 98 of the manhole cap 54 and sealed to the outer surface 106 of the hat 96. This optionally providing a sliding seal between the hat 96 and the, manhole cap 54 hindering fluid there past.

The following definitions are used in this disclosure:

Bell and Spigot: A connection between two sections of pipe, or between a pipe and a connector, or between two fluid connectors. The straight "spigot" end of one section is inserted in the flared-out "bell" end of the adjoining section; the joint is sealed by a caulking compound or with a compressible ring.

Bell: a pipe connection having an inner radial surface which is larger in diameter than the inner radial surface of the adjacent portion of the connection. The radial outer surface of a pipe or connector has an outer end surface which contacts the inner radial surface of the bell and forms a fluid connection thereto.

Spigot: a pipe connection having an outer radial surface which fits into an inner radial surface "bell" of a connecting fluid conduit and forms a fluid connection thereto.

Tapered: to diminish or reduce in thickness toward one end.

Aggregate: any of various loose, particulate materials, as sand, gravel, or pebbles, added to a cementing agent to make concrete, plaster, etc.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A manhole assembly comprising:

a manhole base comprising an aggregate main body having an upper surface forming a radially outward upper edge, and a radially outward surface;

a radial spigot in the radially outward upper edge of the manhole base;

a manhole riser comprised of a corrosive-resistant structural polymer pipe having an inner surface sealed to the radial spigot and a bottom surface in contact with, supported by, and sealed to the radial spigot;

a manhole cap comprising an aggregate main body having an upper surface;

and a radially outward surface;

a radial spigot in the radially outward bottom edge of the manhole cap;

the radial spigot in the radially outward bottom edge of the manhole cap contacting the inner surface of the manhole riser; and the manhole cap resting upon and supported by an upper edge of the manhole riser.

2. The manhole assembly as recited in claim 1 wherein the manhole riser comprises a monolithic polymer.

3. The manhole assembly as recited in claim 2 wherein the manhole riser comprises polyvinyl chloride.

4. The manhole assembly as recited in claim 2 wherein the riser consists of polyvinyl chloride.

5. The manhole assembly as recited in claim 1 wherein the aggregate material is concrete.

6. The manhole assembly as recited in claim 1 wherein the manhole base has an outer diameter equivalent and substantially aligned with the outer diameter of the riser.

7. The manhole assembly as recited in claim 6 further comprising a wrap seal sealed to the radially outer surface of the riser and the manhole base.

8. The manhole assembly as recited in claim 1 wherein the manhole cap has an outer diameter equivalent and substantially aligned with the outer diameter of the riser.

9. The manhole assembly as recited in claim 8 further comprising a wrap seal sealed to the radially outer surface of the riser and the manhole cap.

10. The manhole assembly as recited in claim 1 wherein the riser is a length of straight pipe.

11. The manhole assembly as recited in claim 10 wherein the pipe is a monolithic structure of corrosion resistant material.

12. The manhole assembly as recited in claim 1 wherein the manhole cap having a continuous corrosive-resistant layer covering the bottom surface, radial spigot, and access hole.

13. The manhole assembly as recited in claim 1 wherein the manhole base comprises a continuous corrosive-resistant layer covering the channels, bench, and radial spigot.

14. The manhole assembly as recited in claim 1 wherein the radially outward surface of the manhole cap is substantially aligned with the radially outward surface of the manhole riser, and the radially outward surface of the manhole base is aligned with the radially outward surface of the manhole riser.

15. The manhole assembly as recited in claim 14 further comprising a first wrap seal sealed to the radially outer surface of the riser and the manhole cap; and a second wrap seal sealed to the radially outer surface of the riser and the manhole base.

* * * * *